US010767869B2

(12) United States Patent
Holzinger et al.

(10) Patent No.: US 10,767,869 B2
(45) Date of Patent: Sep. 8, 2020

(54) USER INTERFACE FOR A COOKING HOB

(71) Applicant: ELECTROLUX APPLIANCES AKTIEBOLAG, Stockholm (SE)

(72) Inventors: Jochen Holzinger, Rothenburg ob der Tauber (DE); Alexander Hauck, Rothenburg ob der Tauber (DE); Claus Meider, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 328 days.

(21) Appl. No.: 15/744,933

(22) PCT Filed: Jul. 18, 2016

(86) PCT No.: PCT/EP2016/067071

§ 371 (c)(1),
(2) Date: Jan. 15, 2018

(87) PCT Pub. No.: WO2017/025280

PCT Pub. Date: Feb. 16, 2017

(65) Prior Publication Data

US 2018/0209658 A1 Jul. 26, 2018

(30) Foreign Application Priority Data

Aug. 11, 2015 (EP) ..... 15180466

(51) Int. Cl.
*F24C 7/08* (2006.01)

(52) U.S. Cl.
CPC ..... *F24C 7/086* (2013.01); *F24C 7/083* (2013.01)

(58) Field of Classification Search
CPC ..... F24C 7/086; F24C 7/083
See application file for complete search history.

(56) References Cited

U.S. PATENT DOCUMENTS

2006/0036338 A1* 2/2006 Harkcom ..... G05B 19/104 700/83
2011/0148773 A1* 6/2011 Rudolph ..... H03K 17/96 345/173

(Continued)

FOREIGN PATENT DOCUMENTS

| | | |
|---|---|---|
| EP | 0990855 | 4/2000 |
| EP | 1876515 | 1/2008 |
| EP | 2741010 | 6/2014 |

OTHER PUBLICATIONS

International Search Report and Written Opinion for PCT/EP2016/067071 dated Aug. 10, 2016, 8 pages.

*Primary Examiner* — Donnell A Long
(74) *Attorney, Agent, or Firm* — Pearne & Gordon LLP

(57) ABSTRACT

The present invention relates to a user interface (10) for a cooking hob. The user interface (10) or at least a portion of said user interface (10) is subdivided into partitions (12). Each partition (12) corresponds with a cooking zone of the cooking hob. Each partition (12) comprises a digital display (20), at least one power input device (22) and at least one timer input device (24). The digital display (20) includes at least two seven-segment digits. The digital display (20) is provided for indicating a current cooking parameter, in particular a current power value, of the corresponding cooking zone and a current timer value relating to said corresponding cooking zone. Further, the present invention relates to a cooking hob with at least one user interface (10).

20 Claims, 2 Drawing Sheets

(56) References Cited

U.S. PATENT DOCUMENTS

Figure 1:
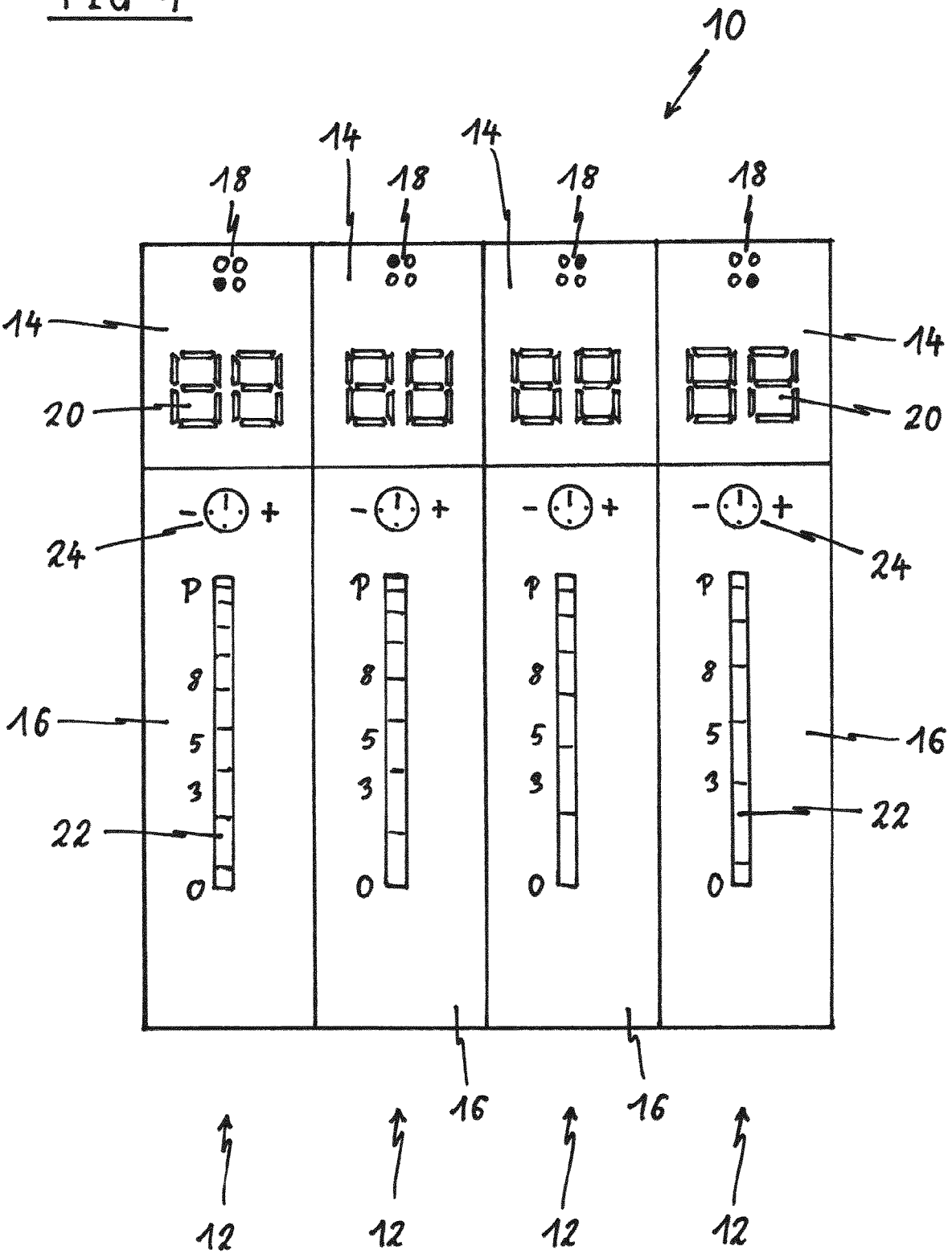

| | | | | |
|---|---|---|---|---|
| 2014/0201688 | A1* | 7/2014 | Guilleminot | G06F 3/017<br>715/863 |
| 2015/0122797 | A1* | 5/2015 | Eggers | H05B 3/688<br>219/450.1 |
| 2015/0308694 | A1* | 10/2015 | Christiansen | H05B 6/12<br>219/626 |
| 2017/0023256 | A1* | 1/2017 | Bach | G06F 3/04847 |
| 2018/0328591 | A1* | 11/2018 | Eggers | F24C 7/083 |

* cited by examiner

USER INTERFACE FOR A COOKING HOB

The present invention relates to a user interface for a cooking hob. Further, the present invention relates to a cooking hob comprising at least one user interface.

A conventional cooking hob comprises a timer display and power level displays. Usually, the timer display is provided for all cooking zones of the cooking hob. However, it is often difficult for the user to recognize, to which of the cooking zones the timer display currently relates.

It is an object of the present invention to provide a user interface for a cooking hob, wherein the user can easily recognize the correlation between the timer display and the corresponding cooking zone.

According to the present invention a user interface for a cooking hob is provided, wherein

- the user interface or at least a portion of said user interface is subdivided into partitions,
- each partition corresponds with a cooking zone of the cooking hob,
- each partition comprises a digital display, at least one power input device and at least one timer input device,
- the digital display includes at least two seven-segment digits, and
- the digital display is provided for indicating a current cooking parameter, in particular a current power value, of the corresponding cooking zone and a current timer value relating to said corresponding cooking zone.

The indication of the current timer value by the digital display arranged within the partition for the corresponding cooking zone allows a clear correlation between said current timer value and said corresponding cooking zone. A dedicated digital display is provided for each cooking zone, wherein said digital display indicates at least temporarily the current timer value.

According to a preferred example, the digital display is provided for an alternating indication of the current cooking parameter or current power value, respectively, of the corresponding cooking zone and the current timer value relating to said corresponding cooking zone.

In particular, the digital display indicates standardly the current cooking parameter or current power value, respectively, of the corresponding cooking zone and, if the timer input device has been operated by a user, the current timer value relating to said corresponding cooking zone, wherein preferably the power input device becomes invisible, when the current timer value is indicated.

Further, the digital display may indicate the current cooking parameter or current power value, respectively, of the corresponding cooking zone again, if the timer input device has been operated by the user again or automatically after a predetermined time interval.

According to another example, the digital display is provided for a simultaneous indication of the current cooking parameter or current power value, respectively, of the corresponding cooking zone and the current timer value relating to said corresponding cooking zone.

In this case, the digital display may include at least three seven-segment digits, wherein at least one seven-segment digit is provided for indicating the current cooking parameter or current power value, respectively, of the corresponding cooking zone and at least two seven-segment digits are provided for indicating the current timer value relating to said corresponding cooking zone.

Preferably, the power input device and/or the timer input device includes touch-sensitive elements.

According to the preferred embodiments of the present invention, the power input device is formed as a linear or circular slider.

For example, the timer input device includes at least a timer-select button, a rising button and a lowering button, wherein preferably the timer-select button is provided for activating and/or deactivating the indication of the timer value on the digital display, the rising button is provided for increasing the timer value and the lowering button is provided for decreasing the timer value.

According to one embodiment, the partitions are arranged side-by-side on the user interface.

According to another embodiment, the partitions are arranged as a matrix on the user interface, wherein preferably the partitions are arranged in positions according to the positions of the corresponding cooking zones on the cooking hob.

Additionally, the partition may include a cooking zone indicator, wherein preferably said cooking zone indicator is a symbol representing the position of the corresponding cooking zone on the cooking hob.

Further, the present invention relates to a cooking hob with at least one user interface, wherein the cooking hob comprises at least one user interface mentioned above.

For example, the at least one user interface is an integrated part of the cooking hob. Alternatively, the at least one user interface may be arranged separately from the cooking hob.

At last, the user interface may form one or more physical units. Said more physical units of the user interface may be arranged in such a way that the user recognizes the correlation between the partition and the corresponding cooking zone.

Novel and inventive features of the present invention are set forth in the appended claims.

Figure 2:
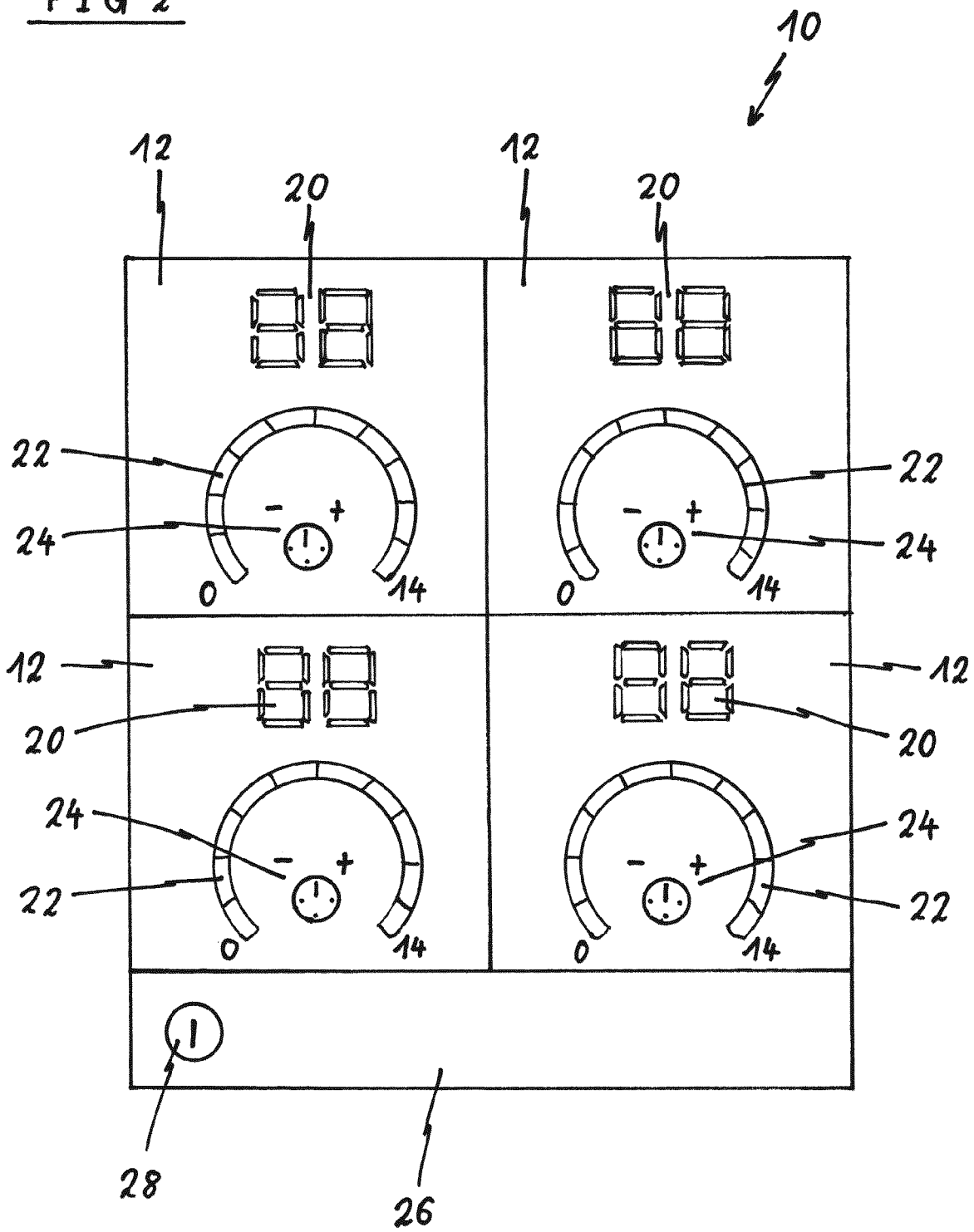

The present invention will be described in further detail with reference to the drawing, in which FIG. 1 illustrates a schematic top view of a user interface for a cooking hob according to a first embodiment of the present invention, and FIG. 2 illustrates a schematic top view of the user interface for a cooking hob according to second embodiment of the present invention.

FIG. 1 illustrates a schematic top view of a user interface 10 for a cooking hob according to a first embodiment of the present invention. The user interface 10 is provided for a cooking hob.

The user interface 10 includes four partitions 12. Each partition 12 corresponds with one cooking zone of the cooking hob. In general, the number of partitions is adapted to the number of cooking zones of the cooking hob. The four partitions 12 of the user interface 10 are arranged side-by-side. In this example, the four partitions 12 of the user interface 10 are identical to each other. Alternatively, the single partitions 12 may be adapted to special properties of the corresponding cooking zones.

Each partition 12 comprises a display device 14 and an input device 16. The display device 14 and the input device 16 of the same partition 12 are arranged in a row. The display device 14 includes a cooking zone indicator 18 and a digital display 20. The cooking zone indicator 18 is a symbolic representation of the cooking hob and indicates the cooking zone corresponding with the partition 12. The digital display 20 of each display device 14 includes seven-segment digits. In this example, each digital display 20 includes two seven-segment digits. In general, the digital display 20 includes two or more seven-segment digits. The input device 16 includes a power input device 22 and a timer input device 24. In this example, the power input device 22 and the timer input device 24 are touch-sensitive elements.

The digital display 20 of each display device 14 is provided for indicating a current cooking parameter, in particular a current power level, and a current timer value of the same cooking zone. In this example, the digital display 20 indicates alternately the current cooking parameter or the current power level, respectively, and the current timer value. Alternatively, the current cooking parameter or the current power level, respectively, and the current timer value may be indicated simultaneously by three or more seven-segment digits.

The power input device 22 is formed as a touch-sensitive linear slider. The possible power levels of the corresponding coking zone are activatable by touching an analogous position on said touch-sensitive linear slider. When the user activates a certain power level, then said power level is indicated by the digital display 20. In a standard state, the digital display 20 of each display device 14 indicates the current power level of the corresponding coking zone, while the timer value is not indicated currently.

The timer input device 24 is provided for setting the cooking time of the corresponding coking zone. In this example, the timer input device 24 includes a timer-select button, a rising button and a lowering button. The timer-select button is arranged in a central position of the timer input device 24. The rising button is represented by a plus sign, while the lowering button is represented by a minus sign. When the timer-select button of the timer input device 24 is touched by the user, then the digital display 20 changes from the current power level to the current timer level. Preferably, the digital display 20 indicates the residual cooking time of a cooking process. The rising button and the lowering button are provided for setting a timer value by the user. The timer value may be increased by the rising button. In a similar way, the timer value may be decreased by the lowering button. Preferably, the power input device 24 becomes invisible, when the current timer value is indicated by the digital display 20. In this situation, the power input device 24 does respond to any operation by the user.

The digital display 20 indicates the current timer level, until the user touches the timer-select button again or automatically after a predetermined time interval. Then, the digital display 20 indicates the current power level again.

Moreover, the user interface 10 may include a common partition, which is not shown in FIG. 1. Said common partition may include an input and/or display device relating commonly to the cooking hob, but not to the single cooking zones. The common partition and the user interface 10 may form either a common physical unit or two or more separate physical units.

FIG. 2 illustrates a schematic top view of the user interface 10 for a cooking hob according to second embodiment of the present invention. This user interface 10 is also provided for a cooking hob.

The user interface 10 includes four partitions 12, wherein each partition 12 corresponds with one cooking zone of the cooking hob. The four partitions 12 of the user interface 10 are arranged as a two-by-two matrix. The four partitions 12 of the user interface 10 are arranged in a similar way as the corresponding cooking zones on the cooking hob. Thus, the cooking zone indicators 18 of the first embodiment are non-essential for the user interface 10 according to the second embodiment.

Each partition 12 comprises the digital display 20, the power input device 22 and the timer input device 24. The digital display 20 includes two seven-segment digits. In general, the digital display 20 includes two or more seven-segment digits. The digital display 20 is provided for indicating the current cooking parameter, in particular the current power value, and the current timer value. In this example, the digital display 20 indicates alternately the current power value and the current timer value. Alternatively, the current power level and the current timer value may be indicated simultaneously by three or more seven-segment digits.

The power input device 22 is formed as a touch-sensitive circular slider. The possible power levels of the corresponding coking zone are activatable by touching an analogous position on said touch-sensitive circular slider. After the user has activated a certain power level, the current power value is indicated by the digital display 20. In the standard state, the digital display 20 of each display device 14 indicates the current power value of the corresponding coking zone, while the current timer value is not indicated at the same time.

The timer input device 24 is arranged within the power input device 22 formed as touch-sensitive circular slider. The timer input device 24 is provided for setting the cooking time of the corresponding coking zone. Also in this example, the timer input device 24 includes the timer-select button, the rising button and the lowering button. The rising button is represented by the plus sign, while the lowering button is represented by the minus sign. When the timer-select button of the timer input device 24 is touched by the user, then the digital display 20 changes from the current power level to the current timer level. Preferably, the digital display 20 indicates the residual cooking time of the cooking process. The timer value may be increased by the rising button. In a similar way, the timer value may be decreased by the lowering button.

The digital display 20 indicates the current timer level, until the user touches the timer-select button again or automatically after a predetermined time interval. Then, the digital display 20 indicates the current power level again.

Additionally, the user interface 10 includes a common partition 26. In this example, said common partition 26 includes an on-off switch 28 for activating and deactivating the cooking hob. In general, the common partition 26 includes input and/or display elements relating commonly to the cooking hob, but not to the single cooking zones. In this example, the user interface 10 with the common partition 26 forms a common physical unit. Alternatively, the user interface 10 and the common partition 26 are formed as two separate physical units.

The user interfaces 10 shown in FIGS. 1 and 2 are formed as one physical unit in each case. Alternatively, the user interface 10 may be formed as two or more physical units, wherein each physical unit includes one or more partitions 12. For example, a first physical unit of the user interface 10 is arranged on a left front corner of the cooking hob and includes the partitions 12 corresponding with the cooking zones on the left hand side of said cooking hob. In a similar way, a second physical unit of the user interface 10 may be arranged on a right front corner of the cooking hob and includes the partitions 12 corresponding with the cooking zones on the right hand side of said cooking hob.

The arrangement of the digital display 20, which indicates at least temporarily the current timer value of the corresponding cooking zone, within the partition 12 for said cooking zone allows a clear correlation between the current timer value and the corresponding cooking zone. For each cooking zone, an own digital display 20, which indicates at least temporarily the current timer value, is provided.

In the embodiments mentioned above, the current cooking parameter is the current power level of the corresponding cooking zone. Further, the current cooking parameter may be a cooking step or broiling step of an automatic cooking function, for example.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 user interface
12 partition
14 display device
16 input device
18 cooking zone indicator
20 digital display
22 power input device
24 timer input device
26 common partition
28 on-off switch

The invention claimed is:

1. A user interface for a cooking hob, wherein:
the user interface or at least a portion of said user interface is subdivided into partitions,
each partition corresponds with one of cooking zones of the cooking hob,
each partition comprises a digital display, and
the digital display in each partition includes:
at least two digits for alternatively displaying a current timer value and a current cooking parameter relating to a corresponding cooking zone,
a graphic bar input device for adjusting the current cooking parameter of the corresponding cooking zone, and
a timer input device for adjusting the current timer value of the corresponding cooking zone.

2. The user interface according to claim 1, wherein the digital display is provided for an alternating indication of the current cooking parameter of the corresponding cooking zone and the current timer value relating to said corresponding cooking zone.

3. The user interface according to claim 2, wherein the digital display indicates standardly the current cooking parameter of the corresponding cooking zone and, if the timer input device has been operated by a user, the digital display is switched to indicate the current timer value relating to said corresponding cooking zone.

4. The user interface according to claim 3, wherein the digital display is switched to indicate the current cooking parameter of the corresponding cooking zone again, if the timer input device has been operated by the user again or automatically after a predetermined time interval.

5. The user interface according to claim 3, wherein the power input device becomes invisible when the current timer value is indicated.

6. The user interface according to claim 1, wherein the digital display is provided for a simultaneous indication of the current cooking parameter of the corresponding cooking zone and the current timer value relating to said corresponding cooking zone.

7. The user interface according to claim 6, wherein the digital display includes at least digits, wherein at least one digit is provided for indicating the current cooking parameter of the corresponding cooking zone and at least two digits are provided for indicating the current timer value relating to said corresponding cooking zone.

8. The user interface according to claim 1, wherein the graphic bar input input device and/or the timer input device includes touch-sensitive elements.

9. The user interface according to claim 1, wherein the graphic bar input device is a power input device formed as a linear or circular slider.

10. The user interface according to claim 1, wherein the timer input device includes at least a timer-select button, a rising button and a lowering button, wherein the timer-select button is provided for activating and/or deactivating the indication of the timer value on the digital display, the rising button is provided for increasing the timer value and the lowering button is provided for decreasing the timer value.

11. The user interface according to claim 1, wherein the partitions are arranged side-by-side on the user interface.

12. The user interface according to claim 1, wherein the partitions are arranged as a matrix on the user interface in positions according to the positions of the corresponding cooking zones on the cooking hob.

13. The user interface according to claim 1, wherein the partition includes a cooking zone indicator, wherein said cooking zone indicator is a symbol representing the position of the corresponding cooking zone on the cooking hob.

14. A cooking hob comprising the user interface according claim 1.

15. The cooking hob according to claim 14, wherein a portion of the one user interface is an integrated part of the cooking hob.

16. The cooking hob according to claim 14, wherein the user interface forms one or more physical units.

17. The user interface according to claim 1, said current cooking parameter being a current power value.

18. A cooking hob, comprising:
a plurality of cooking zones; and
a user interface including a plurality of partitions, wherein:
each partition corresponds with each one of the plurality of cooking zones;
each partition comprises a digital display that includes:
at least two digits for alternatively displaying a timer value and a cooking parameter relating to a corresponding cooking zone,
a time input device for adjusting the timer value of the corresponding cooking zone, and
a power input device for adjusting the cooking parameter of the corresponding cooking zone.

19. The user interface according to claim 18, wherein the current cooking parameter is a power level of the corresponding cooking zone.

20. A cooking hob, comprising:
a plurality of cooking zones; and
a user interface including a plurality of partitions, wherein:
each partition corresponds with each one of the plurality of cooking zones;
each partition comprises a digital display that includes:
at least two digits for simultaneously displaying a timer value and a cooking parameter relating to a corresponding cooking zone,
a time input device for adjusting the timer value of the corresponding cooking zone, and a power input device for adjusting the cooking parameter of the corresponding cooking zone.

* * * * *